US012516515B2

(12) United States Patent
Okabe et al.

(10) Patent No.: US 12,516,515 B2
(45) Date of Patent: Jan. 6, 2026

(54) FLUSH TOILET

(71) Applicant: TOTO LTD., Kitakyushu (JP)

(72) Inventors: Daiki Okabe, Kitakyushu (JP); Makoto Bekki, Kitakyushu (JP); Shoko Kobayashi, Kitakyushu (JP); Shoki Ko, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 67 days.

(21) Appl. No.: 18/587,009

(22) Filed: Feb. 26, 2024

(65) Prior Publication Data

US 2024/0287779 A1 Aug. 29, 2024

(30) Foreign Application Priority Data

Feb. 28, 2023 (JP) ..... 2023-029540
Feb. 28, 2023 (JP) ..... 2023-029541
Dec. 1, 2023 (JP) ..... 2023-204099

(51) Int. Cl.
*E03D 11/08* (2006.01)

(52) U.S. Cl.
CPC ..... *E03D 11/08* (2013.01)

(58) Field of Classification Search
CPC ..... E03D 11/08
USPC ..... 4/420, 300, 256.1, 901, 905
See application file for complete search history.

(56) References Cited

U.S. PATENT DOCUMENTS 6,115,853 A * 9/2000 Shibata ..... E03D 11/08 4/420
8,695,126 B2 * 4/2014 Yoneda ..... E03D 11/08 4/429
11,643,799 B2 * 5/2023 Ishimi ..... E03D 3/00 4/420

(Continued)

FOREIGN PATENT DOCUMENTS

CN 1806082 A 7/2006
EP 3216929 A1 * 9/2017 ..... E03D 11/08

(Continued)

OTHER PUBLICATIONS

An Office Action; mailed by the Japanese Patent Office on Aug. 15, 2024, which corresponds to Japanese Patent Application No. 2023-029540 and is related to U.S. Appl. No. 18/587,009.

(Continued)

*Primary Examiner* — Lori L Baker
(74) *Attorney, Agent, or Firm* — Studebaker Brackett PLLC

(57) ABSTRACT

A flush toilet that is flushed with flush water to discharge waste is provided. The flush toilet includes a bowl that includes a waste receiving surface, a rim, and a well portion, a first spouting port that is formed in the rim and from which the flush water is spouted along an inner circumference surface of the rim, a first water passage that guides the flush water to the first spouting port, and a discharge conduit. The first water passage includes a lower water passage formed into a vertically long rectangular shape, and an upper water passage having a smaller width than the width of the lower (Continued)

water passage and extending upward from the lower water passage, and a height dimension of the first spouting port is set to be substantially the same as the height dimension of the first water passage.

13 Claims, 16 Drawing Sheets

(56) References Cited

U.S. PATENT DOCUMENTS

| | | | | |
|---|---|---|---|---|
| 11,788,268 | B2 * | 10/2023 | Ishimi | E03D 11/08 4/420 |
| 12,275,064 | B2 * | 4/2025 | King | B33Y 50/00 |
| 2006/0005310 | A1 | 1/2006 | Nakamura et al. | |
| 2006/0096017 | A1 * | 5/2006 | Yamasaki | G01F 23/00 4/420 |
| 2007/0061955 | A1 | 3/2007 | Asada et al. | |
| 2013/0047328 | A1 * | 2/2013 | Yamasaki | E03D 11/08 4/420 |
| 2015/0026876 | A1 * | 1/2015 | Shirakawa | E03D 11/08 4/420 |
| 2015/0275494 | A1 * | 10/2015 | Kashirajima | E03D 11/02 4/420 |
| 2016/0138255 | A1 * | 5/2016 | Kitamura | E03D 11/08 4/420 |
| 2017/0260730 | A1 | 9/2017 | Kashirajima et al. | |
| 2018/0155912 | A1 | 6/2018 | Kashirajima et al. | |
| 2021/0372108 | A1 * | 12/2021 | Matsunaka | E03D 11/08 |
| 2022/0275614 | A1 * | 9/2022 | Eto | E03D 5/01 |
| 2022/0275621 | A1 * | 9/2022 | Ishimi | E03D 11/08 |
| 2022/0275624 | A1 * | 9/2022 | Ishimi | E03D 11/08 |
| 2022/0275627 | A1 * | 9/2022 | Maruyama | E03D 11/18 |
| 2023/0035354 | A1 * | 2/2023 | Eto | E03D 11/025 |
| 2023/0066417 | A1 * | 3/2023 | Hashimoto | E03D 11/08 |
| 2023/0100206 | A1 * | 3/2023 | Hashimoto | E03D 11/08 4/300 |
| 2024/0060283 | A1 * | 2/2024 | Chen | E03D 11/08 |
| 2024/0287778 | A1 * | 8/2024 | Okabe | E03D 11/08 |
| 2025/0043559 | A1 * | 2/2025 | Nakamura | E03D 11/08 |
| 2025/0043561 | A1 * | 2/2025 | Matsumura | E03D 1/30 |
| 2025/0059749 | A1 * | 2/2025 | Kashimura | E03D 1/32 |
| 2025/0075484 | A1 * | 3/2025 | Bekki | E03D 11/08 |
| 2025/0109581 | A1 * | 4/2025 | Kashirajima | E03D 5/105 |
| 2025/0178088 | A1 * | 6/2025 | Stevens | B22F 12/53 |

FOREIGN PATENT DOCUMENTS

| | | | | |
|---|---|---|---|---|
| JP | 2001279791 | A * | 10/2001 | E03D 11/08 |
| JP | 2004-156308 | A | 6/2004 | |
| JP | WO2004/022862 | A1 | 12/2005 | |
| JP | 2012-202143 | A | 10/2012 | |
| JP | 2015-168994 | A | 9/2015 | |
| JP | 2017-160671 | A | 9/2017 | |
| JP | 2018-012995 | A | 1/2018 | |
| JP | 2018-091110 | A | 6/2018 | |
| JP | 2019044428 | A * | 3/2019 | E03D 11/08 |
| JP | 2019-173305 | A | 10/2019 | |
| JP | 2020-109255 | A | 7/2020 | |
| JP | 2020-165172 | A | 10/2020 | |
| JP | 2021-036130 | A | 3/2021 | |
| JP | 7123307 | B1 * | 8/2022 | E03D 11/17 |

OTHER PUBLICATIONS

An Office Action; "Notice of Reasons for Refusal," mailed by the Japanese Patent Office on Aug. 15, 2024, which corresponds to Japanese Patent Application No. 2023-029540; resubmitted with English language translation.

An Office Action; "Notice of Reasons for Refusal," mailed by the Japanese Patent Office on Sep. 26, 2024, which corresponds to Japanese Patent Application No. 2023-204099.

Decision to Grant; mailed by the Japanese Patent Office on Jan. 6, 2025, which corresponds to Japanese Patent Application No. 2023-204099 and is related to U.S. Appl. No. 18/587,009.

* cited by examiner

FLUSH TOILET

BACKGROUND OF THE INVENTION

Field of the Invention

The present invention relates to a flush toilet, and particularly relates to a flush toilet that suppresses involvement of air during spouting of flush water to achieve spouting of flush water from a spouting port toward a target region in a bowl.

Description of the Related Art

For example, as disclosed in Japanese Patent Laid-Open No. 2004-156308 and Japanese Patent Laid-Open No. 2017-160671, flush toilets have been conventionally known in which flush water is spouted along an inner circumference surface of a rim from a rim spout port and forms a circulating flow in a bowl to flush the bowl.

In the flush toilet disclosed in Japanese Patent Laid-Open No. 2004-156308, a rim water passage is gradually reduced in rim toward the rim spout port, thereby enabling flush water to be spouted toward the bowl.

In the flush toilet disclosed in Japanese Patent Laid-Open No. 2017-160671, a flow path of a rim water passage has a vertically-long shaped cross section, thereby reducing a space in which air is retained to suppress involvement of air when flush water flows in the rim water passage.

However, in the above-described flush toilets disclosed in Japanese Patent Laid-Open No. 2004-156308 and Japanese Patent Laid-Open No. 2017-160671, a rim spout port is formed into a rectangular shape with an aspect ratio of substantially one to one, which may cause involvement of air when flush water passes through the rim spout port. When flush water involves air, a water spouting direction of flush water is disturbed, which may make it impossible to spout flush water toward target regions in the bowl.

In particular, in a wash-down toilet that has a larger pooled water surface than a conventional one, when flush water spouted from a rim spout port does not reach a target region in the pooled water surface, a disturbance is generated on the pooled water surface. Even when the pooled water surface is pressed by flush water in this state, floating waste that is floating on the pooled water surface cannot be sufficiently discharged. Accordingly, in the wash-down toilet that has a large pooled water surface, the above-described problem is an extremely important problem to be solved.

The present invention has been made to solve the above-described problem, and has an object to provide a flush toilet that suppresses involvement of air during spouting of flush water to achieve spouting of flush water from a spouting port toward a target region in a bowl.

SUMMARY OF THE INVENTION

In order to achieve the above-described object, the present invention provides a flush toilet that is flushed with flush water to discharge waste, the flush toilet including a bowl that includes a waste receiving surface that receives waste, a rim that is formed in an upper portion of the waste receiving surface, and a well portion that is formed in a lower portion of the waste receiving surface and inside which a pooled water surface is formed, a spouting port that is formed in the rim and from which the flush water is spouted along an inner circumference surface of the rim, a water passage that guides the flush water to the spouting port, and a discharge conduit that is connected to a bottom of the bowl, wherein the water passage includes a lower water passage formed into a vertically long rectangular shape, and an upper water passage having a smaller width than the width of the lower water passage and extending upward from the lower water passage, and a height dimension of the spouting port is set to be substantially the same as the height dimension of the water passage.

In the present invention thus configured, since the water passage includes the lower water passage formed into a vertically long rectangular shape, and the upper water passage formed to have a smaller width than the width of the lower water passage and extending upward from the lower water passage, the lower water passage is filled with the flush water when the flush water is supplied to the lower water passage, and air retained in the water passage is forced upward to the upper water passage. Hereby, the flush water flows in the lower water passage and the air flows in the upper water passage, whereby the air and the flush water can flow while separating from each other. Since the height dimension of the spouting port is set to be substantially the same as the height dimension of the water passage, the flush water is spouted from the lower region of the spouting port toward the target regions in the bowl, and the air is discharged from the upper region of the spouting port. Thus, the air and the flush water are discharged from the spouting port while separating from each other, which makes it possible to suppress involvement of air during spouting of the flush water and spout the flush water from the spouting port toward the target regions in the bowl.

In the present invention, preferably, on a downstream side of the water passage, an upper surface of the lower water passage is inclined downward from upstream toward the spouting port.

In the present invention thus configured, since on the downstream side of the water passage, the upper surface of the lower water passage is inclined downward from the upstream toward the spouting port, a downward flow is formed by the lower water passage, which makes it possible to spout the water downward from the spouting port.

In the present invention, preferably, on the downstream side of the water passage, the upper surface of the lower water passage is gradually inclined downward from the upstream toward the spouting port.

In the present invention thus configured, since on the downstream side of the water passage, the upper surface of the lower water passage is gradually inclined downward from the upstream toward the spouting port, the downward flow can be formed by the lower water passage while adjusting the flush water.

In the present invention, preferably, on the downstream side of the water passage, an upper surface of an upper water passage extends in a horizontal direction from the upstream toward the spouting port.

In the present invention thus configured, since on the downstream side of the water passage, the upper surface of the upper water passage extends in the horizontal direction from the upstream toward the spouting port, a large space in which air can be accommodated can be formed in the upper water passage, so that the air and the flush water can be discharged from the spouting port while reliably separating from each other.

In the present invention, preferably, the spouting port is disposed on a front side of a center axis in a front and rear direction of the bowl.

In the present invention thus configured, since the spouting port is disposed on the front side of the center axis in the front and rear direction of the bowl, the distance of the water passage can be increased, and the air and the flush water can be discharged from the spouting port while reliably separating from each other.

In the present invention, the spouting port includes a lower opening formed into a vertically long rectangular shape, and an upper opening formed to have a smaller width than the width of the lower opening and extending upward from the lower opening.

In the present invention thus configured, since the spouting port includes the lower opening formed into a vertically long rectangular shape, and the upper opening formed to have a smaller width than the width of the lower opening and extending upward from the lower opening, the flush water is spouted from the lower opening toward the target regions in the bowl, and the air is discharged from the upper opening of the spouting port. Thus, the air and the flush water are discharged from the spouting port while separating from each other, which makes it possible to suppress involvement of air at the spouting port and spout the flush water from the spouting port toward the target regions in the bowl.

In the present invention, a width of the upper water passage starts to increase from a predetermined position on an upstream side of the spouting port toward the spouting port, and is set to be substantially the same as the width of the lower water passage in a position in a vicinity of the spouting port.

In the present invention thus configured, since the width of the upper water passage starts to increase from a predetermined position on the upstream side of the spouting port toward the spouting port, and is set to be substantially the same as the width of the lower water passage in a position in the vicinity of the spouting port, the water passage can be full early after flushing starts, to enable the air and the flush water to separate from each other.

In the present invention, the spouting port is disposed on a front side of a front end of the well portion, and the predetermined position where the width of the upper water passage starts to increase is set to be substantially the same position as the front end of the well portion in a front and rear direction.

In the present invention thus configured, since the spouting port is disposed on the front side of the front end of the well portion, and the predetermined position where the width of the upper water passage starts to increase is set to be substantially the same position as the front end of the well portion in the front and rear direction, the flush water can be spouted from the spouting port so as to circulate on the waste receiving surface on the front side of the front end of the well portion, which makes it possible to guide the flush water to the target regions of the bowl.

In the present invention, a portion where the width of the upper water passage increases is provided in a water passage straight portion in which a water passage extends in a substantially straight line.

In the present invention thus configured, since the portion where the width of the upper water passage increases is provided in the water passage straight portion in which the water passage extends in a substantially straight line, the flush water can be prevented from undergoing pressure loss due to the curvature of the water passage.

In the present invention, the spouting port is formed to be vertically long, and a protrusion that protrudes toward an inside of the bowl is provided on the inner circumference surface of the rim on a downstream side of the spouting port.

In the present invention thus configured, since the spouting port is formed to be vertically long, and the protrusion that protrudes toward the inside of the bowl is provided on the inner circumference surface of the rim on the downstream side of the spouting port, the protrusion is used to cause a part of the flush water that circulates on the inner circumference surface of the rim to flow downward to enable flushing of the waste receiving surface. This enables improvement in flushing performance of the bowl, and can suppress splashing of the flush water out of the flush toilet.

In the present invention, the spouting port is disposed on a front side of a center axis in a front and rear direction of the bowl, and the protrusion is provided at a front end of the inner circumference surface of the rim.

In the present invention thus configured, since the spouting port is provided on the front side of the center axis in the front and rear direction of the bowl and the protrusion is provided at the front end of the inner circumference surface of the rim, the protrusion is used to cause the flush water to flow downward to enable flushing of the waste receiving surface.

In the present invention, the protrusion is provided at least on a front side of a center axis in a front and rear direction of the bowl and at a portion that is formed with a minimum curvature radius in the inner circumference surface of the rim in a plan view of the bowl.

In the present invention thus configured, since the protrusion is provided at least on the front side of the center axis in the front and rear direction of the bowl and at a portion that is formed with the minimum curvature radius in the inner circumference surface of the rim in a plan view of the bowl, when the flush water flows at a portion formed with the minimum curvature radius, the protrusion is used to cause the flush water to flow downward to enable flushing of the waste receiving surface. At the portion formed with the minimum curvature radius where the flush water is highly likely to splash out of the flush toilet, the protrusion is used to cause the flush water to flow downward, which makes it possible to suppress splashing of the flush water out of the flush toilet.

In the present invention, the protrusion is formed so that a degree of protrusion toward the inside of the bowl increases toward downstream, a lower end of the protrusion is inclined downward in a flow direction in which the flush water circulates on the inner circumference surface of the rim, and a lower surface of the protrusion is inclined upward toward the inside of the bowl.

In the present invention thus configured, since the protrusion is formed so that the degree of protrusion toward the inside of the bowl increases toward the downstream, and the lower end of the protrusion is inclined downward in the flow direction in which the flush water circulates on the inner circumference surface of the rim, as the flush water circulates toward the downstream, the flush water flows downward to enable flushing of the waste receiving surface. Since the lower surface of the protrusion is inclined upward toward the inside of the bowl, the lower surface of the protrusion is easily cleaned from above.

According to the flush toilet of the present invention, involvement of air can be suppressed during spouting of flush water to achieve spouting of flush water from a spouting port toward a target region in a bowl.

DETAILED DESCRIPTION OF THE PREFERRED EMBODIMENTS

Hereinafter, a flush toilet according to a first embodiment of the present invention will be described. First, a basic structure of the flush toilet will be described with reference to FIGS. 1 and 2.

Figure 1:
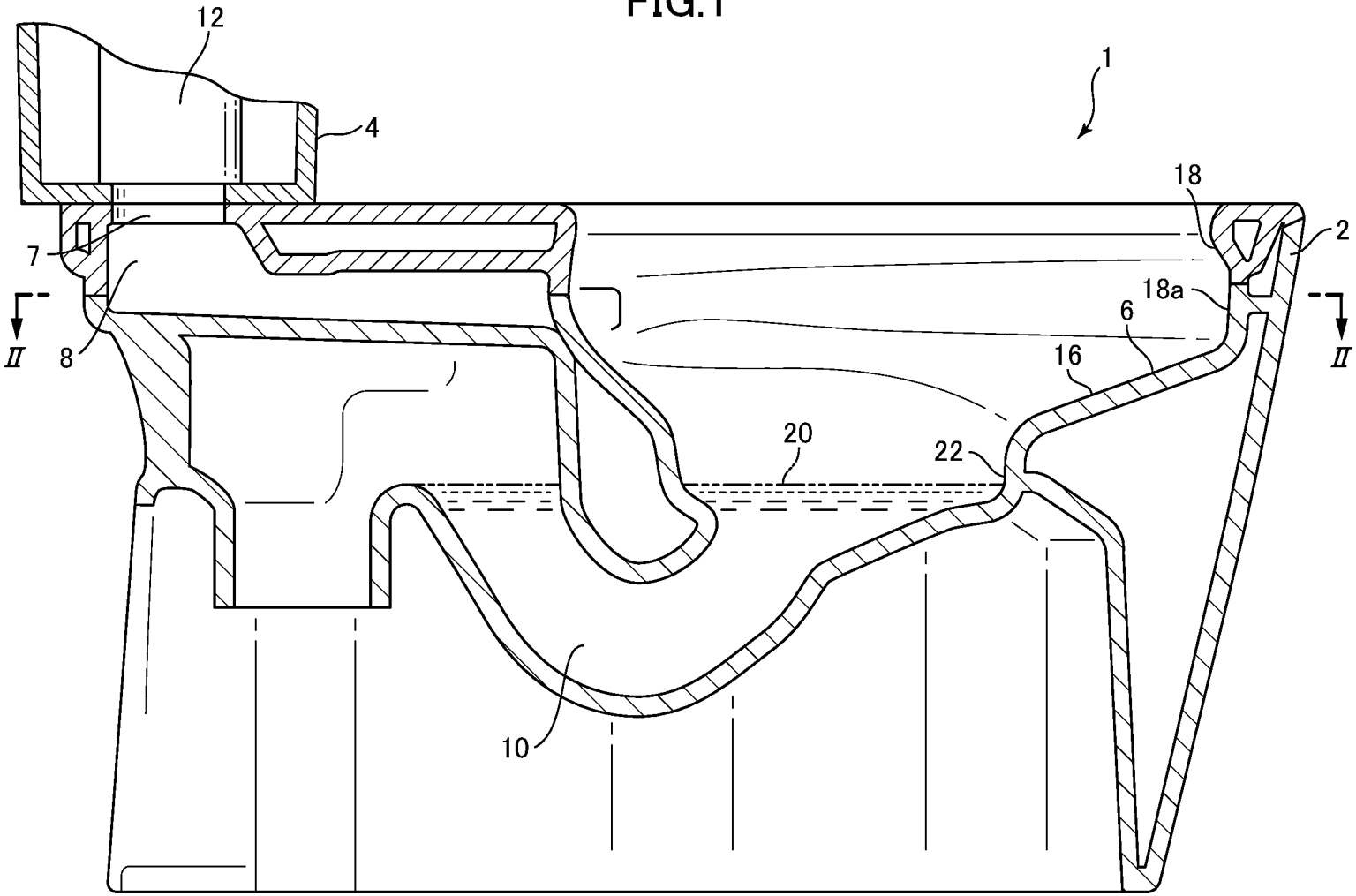
FIG. 1 is a sectional side view of a flush toilet according to a first embodiment of the present invention.
Figure 2:
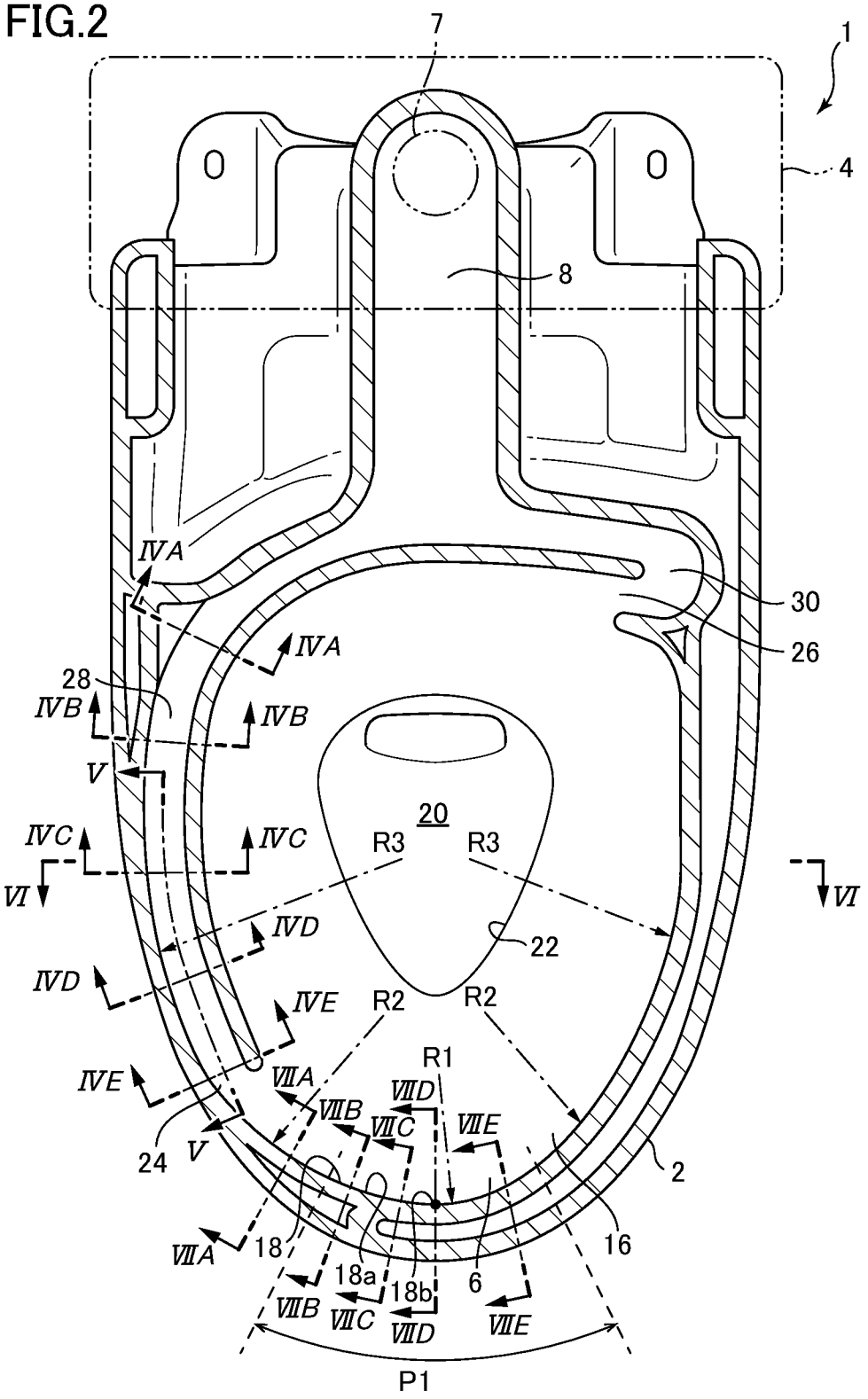
FIG. 2 is a sectional plan view taken along line II-II in FIG. 1.

As illustrated in FIGS. 1 and 2, a flush toilet 1 is a wash down toilet that pushes away waste by the action of running water caused by a difference in a water level inside a bowl. The flush toilet 1 includes a toilet main body 2 made of ceramics, and a storage tank 4 that stores flush water for flushing the toilet main body 2. The toilet main body 2 includes a bowl 6 on a front side, and a common water passage 8 formed in a rear upper portion, the common water passage 8 being provided with an opening 7 at its upstream end so that the opening 7 communicates with the storage tank 4. Furthermore, a discharge conduit 10 for discharging waste is formed in a rear lower portion of the bowl 6.

In the embodiment of the present invention, the wash down toilet is described, but the flush toilet of the present invention is not limited thereto, and includes a siphon toilet that discharges waste by utilizing a siphon action.

Herein, in the present specification, when a user views the flush toilet 1 from the front, the front side of the flush toilet 1 is referred to as the front, the deep side thereof is referred to as the rear, the right side thereof is referred to as the right, and the left side thereof is referred to as the left.

The above-described storage tank 4 includes a discharge valve 12, and is configured so that when a user performs an opening operation on an operation lever (not illustrated), the discharge valve 12 opens, and flush water in the storage tank 4 is supplied to the toilet main body 2. In the present embodiment, an amount of flush water supplied from the storage tank 4 to the toilet main body 2 is about 4.8 liters for large flush and about 3.6 liters for small flush.

In the flush toilet of the present invention, instead of the storage tank 4, it is acceptable to use a tap water direct connection system or to use a flush valve system, as a flush water supply source. Alternatively, the flush water may be supplied using a pump.

The bowl 6 includes a bowl-shaped waste receiving surface 16, a rim 18 formed above the waste receiving surface 16 and having an inner circumference surface 18*a* exposed to the outside, and a well portion 22 formed below the waste receiving surface 16 and forming a pooled water surface 20 therein. The pooled water surface 20 of the well portion 22 has a substantially triangular shape with a size of 160 mm to 180 mm in a front and rear direction and 125 mm to 145 mm in a width direction in a plan view, and is formed to be larger (more enlarged) than a pooled water surface of a conventional wash down toilet. The well portion 22 forms a substantially triangular shape, which is more ovoid (an elliptical shape in which a front side is tapered) than the pooled water surface 20, with a size of 200 mm to 240 mm in the front and rear direction and 150 mm to 190 mm in the width direction in a plan view.

In the rim 18 of the bowl 6, a first spouting port 24 (a spouting port) that spouts flush water is formed at a left-side front position, and a second spouting port 26 that spouts flush water is further formed at a right-side rear position. The above-described common water passage 8 branches into a first water passage 28 and a second water passage 30 toward a downstream side, the first water passage 28 extending to the first spouting port 24, the second water passage 30 extending to the second spouting port 26, so that the flush water is supplied from the storage tank 4 to the first spouting port 24 and the second spouting port 26. Herein, the first spouting port 24 spouts water toward the front of the bowl 6, and the first spouting port 24 and the second spouting port 26 spout flush water in a direction of forming a circulating flow which circulates in the same direction. In the embodiment of the present invention, a counterclockwise circulating flow is formed.

In the flush toilet of the present invention, the number of spout ports may be one, or further may be two or more (for example, three).

Figure 5:
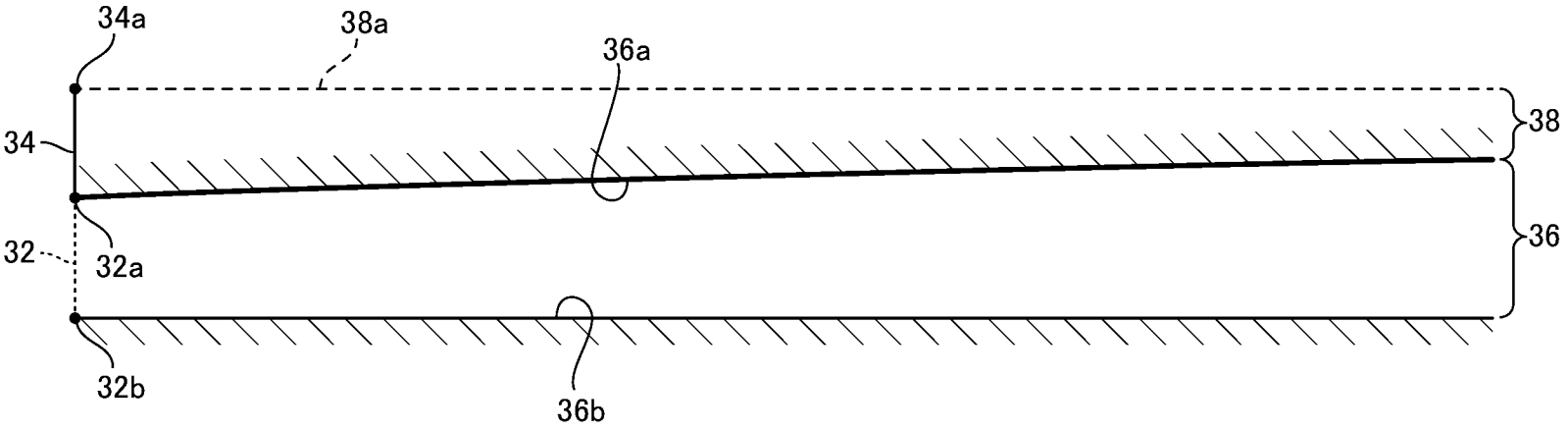
FIG. 5 is a sectional view taken along line V-V in the first water passage illustrated in FIG. 2.

Next, the details of the first spouting port and the first water passage of the flush toilet according to the first embodiment of the present invention will be described with reference to FIGS. 2 and 5.

Figure 3:
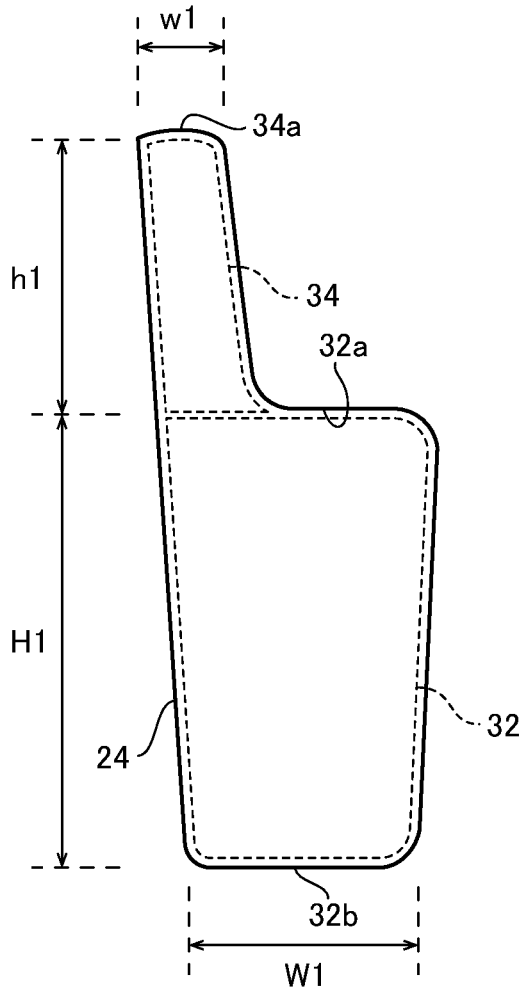
FIG. 3 is a front view of a first spouting port of the flush toilet according to the first embodiment of the present invention.
Figure 4A:
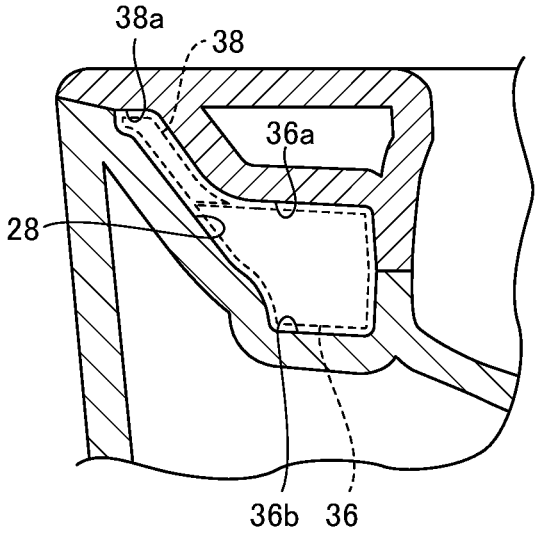
FIG. 4A is a flow path sectional view taken along line IVA-IVA perpendicular to a flow direction of flush water in a first water passage illustrated in FIG. 2.
Figure 4B:
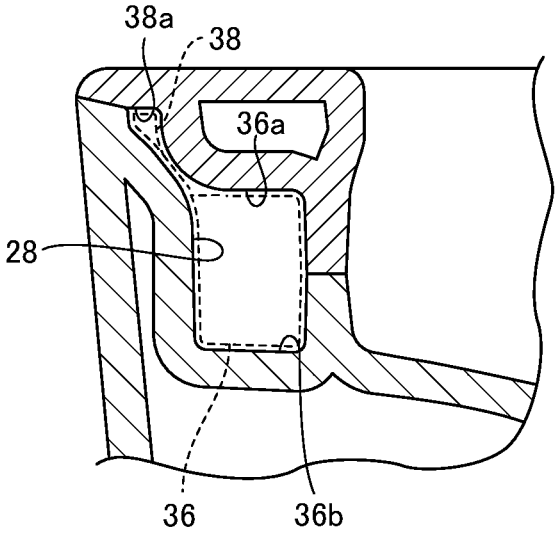
FIG. 4B is a flow path sectional view taken along line IVB-IVB perpendicular to the flow direction of flush water in the first water passage illustrated in FIG. 2.
Figure 4C:
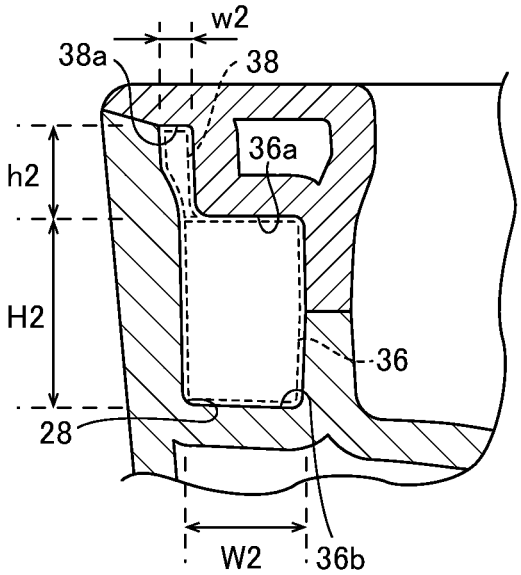
FIG. 4C is a flow path sectional view taken along line IVC-IVC perpendicular to the flow direction of flush water in the first water passage illustrated in FIG. 2.
Figure 4D:
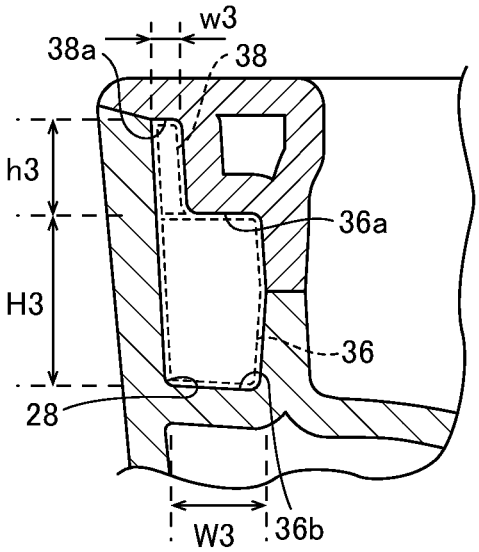
FIG. 4D is a flow path sectional view taken along line IVD-IVD perpendicular to the flow direction of flush water in the first water passage illustrated in FIG. 2.
Figure 4E:
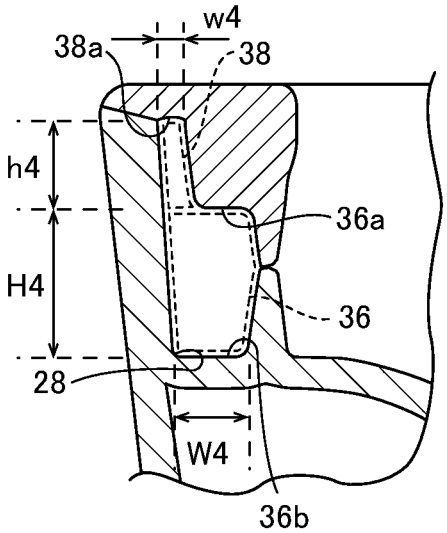
FIG. 4E is a flow path sectional view taken along line IVE-IVE perpendicular to the flow direction of flush water in the first water passage illustrated in FIG. 2.

First, as illustrated in FIG. 3, the first spouting port 24 has an opening cross section formed into an L shape, and includes a lower opening 32 (a portion enclosed by a dotted line in FIG. 3) formed into a vertically-long rectangular shape, and an upper opening 34 (a portion enclosed by a dotted line in FIG. 3) formed to have a smaller width than the width of the lower opening 32 and formed into a vertically-long rectangular shape extending upward from a left side (outside) of an upper end 32*a* of the lower opening 32. The upper end 32*a* and a lower end 32*b* of the lower opening 32 are substantially horizontal. The upper opening 34 is formed to extend upward in the vertical direction from the left side (outer end) of the upper end 32*a* of the lower opening 32. An upper end 34*a* of the upper opening 34 is substantially horizontal. The upper opening 34 and the lower opening 32 are continuous to each other to form one opening.

An opening sectional area of the upper opening 34 is set to have a size of about one sixth of the opening sectional area of the lower opening 32.

Each of the lower opening 32 and the upper opening 34 is formed into a rectangular shape in which a height dimension (H1, h1) is longer than a width (W1, w1). The width (w1) of the upper opening 34 is set to a length of about one third of the width (W1) of the lower opening 32, and the height dimension (h1) of the upper opening 34 is set to a length of about one half of the height dimension (H1) of the lower opening 32.

Figure 8:
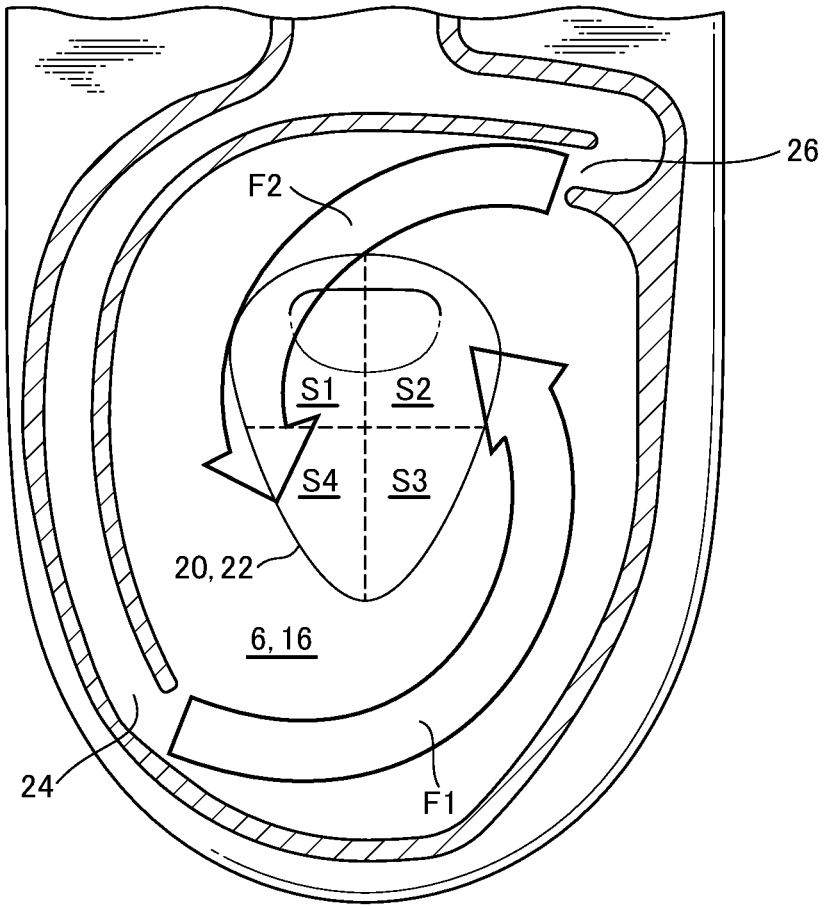
FIG. 8 is a sectional plan view of a bowl in a state where flush water spouted from a first spouting port and a second spouting port flows into a pooled water surface in the flush toilet according to an embodiment of the present invention.

This causes the majority of flush water to be spouted from the lower opening 32, thereby forming a forward main flow F1 that circulates on the bowl 6 (see FIG. 8). On the other hand, from the upper opening 34, air is discharged and a part of the flush water is spouted to flow along the inner circumference surface 18*a* of the rim 18.

Therefore, the forward main flow F1 can be formed which circulates on the bowl 6, and air in the first water passage 28 can be discharged from the first spouting port 24.

As illustrated in FIGS. 4A to 4E, the first water passage 28 has a flow path cross section formed into L shape, and is continuously connected to the first spouting port 24. The first water passage 28 includes, in a cross section, a lower water passage 36 (a portion enclosed by a dotted line in each of FIGS. 4A to 4E) formed into a vertically long rectangular shape, and an upper water passage 38 (a portion enclosed by dotted line in each of FIGS. 4A to 4E) formed to have a smaller width than the width of the lower water passage 36 and formed into a vertically-long rectangular shape extending upward from the lower water passage 36. The upper water passage 38 and the lower water passage 36 are continuous to each other to form one water passage.

On the upstream side (FIGS. 4A and 4B) of the first water passage 28, the upper water passage 38 extends obliquely leftward (outward) and upward from a left end (outer end) of an upper surface 36*a* of the lower water passage 36. On the downstream side (FIGS. 4C to 4E) of the first water passage 28, the upper water passage 38 extends upward in the vertical direction from the left end (outer end) of the upper surface 36*a* of the lower water passage 36.

Thus, on the upstream side (FIGS. 4A and 4B) of the first water passage 28, the curvature is increased along with enlargement of the pooled water surface 20, and a relatively large centrifugal force acts on the flush water, but the upper water passage 38 extends obliquely upward, which makes it possible to suppress vigorous collision of the flush water with an inner wall of the upper water passage 38. Therefore, it is possible to suppress the disturbance of the flush water and the involvement of air due to vigorous collision of the flush water. Furthermore, on the downstream side (FIGS. 4C to 4E) of the first water passage 28, the upper water passage 38 extends upward in the vertical direction, which causes the flush water to be guided to the lower water passage 36, and causes the majority of the flush water to be spouted from the lower opening 32 of the first spouting port 24, whereby a forward main flow F1 that circulates on the bowl 6 can be formed.

On the downstream side (FIGS. 4C to 4E) of the first water passage 28, a flow path sectional area of the upper water passage 38 is set to have a size of about one sixth of the flow path sectional area of the lower water passage 36. Each of the lower water passage 36 and the upper water passage 38 is formed into a rectangular shape in which a height dimension (H2 to H4, h2 to h4) is longer than a width (W2 to W4, w2 to w4). The width (w2 to w4) of the upper water passage 38 is set to a length of about one third of the width (W2 to W4) of the lower water passage 36, and the height dimension (h2 to h4) of the upper water passage 38 is set to a length of about one half of the height dimension (H2 to H4) of the lower water passage 36.

On the downstream side (FIGS. 4C to 4E) of the first water passage 28, the width (W2 to W4) of the lower water passage 36 is gradually reduced from the upstream toward the first spouting port 24. As illustrated in FIG. 5, on the downstream side of the first water passage 28, the upper surface 36*a* of the lower water passage 36 is gradually inclined downward from the upstream toward the first spouting port 24. Specifically, the upper surface 36*a* of the lower water passage 36 is inclined at an inclination angle of about 5° with respect to the horizontal direction. A bottom surface 36*b* of the lower water passage 36 extends in the horizontal direction from the upstream toward the first spouting port 24. That is, the flow path sectional area of the lower water passage 36 is gradually reduced from the upstream toward the first spouting port 24.

Thus, the lower water passage 36 forms a downward flow so that water can be spouted downward from the first spouting port 24, whereby the forward main flow F1 can be formed (see FIG. 8).

On the downstream side (FIGS. 4C to 4E) of the first water passage 28, the width (w2 to w4) of the upper water passage 38 is formed to be substantially constant from the upstream toward the first spouting port 24. As illustrated in FIG. 5, on the downstream side of the first water passage 28, an upper surface 38*a* of the upper water passage 38 extends in the horizontal direction from the upstream toward the first spouting port 24. That is, the flow path sectional area of the upper water passage 38 gradually increases from the upstream toward the first spouting port 24.

Thus, a large space in which air can be accommodated can be formed in the upper water passage 38, so that air and flush water can reliably separate from each other.

As illustrated in FIG. 2, the first spouting port 24 is disposed on the front side of a center axis in the front-rear direction of the bowl 6, and in particular is disposed on the front side of a front end 22*a* of the well portion 22, and the first water passage 28 extends to the first spouting port 24.

Thus, a distance of the water passage can be increased, and air and flush water can be discharged from the first spouting port 24 while reliably separating from each other.

Next, the inner circumference surface of the rim of the flush toilet according to the embodiment of the present invention will be described in detail with reference to FIGS. 2, 6, and 7A to 7E.

First, as illustrated in FIG. 2, on the front side of a center axis in the front-rear direction of the bowl 6 in a plan view, the inner circumference surface 18*a* of the rim 18 has a front end 18*b* formed with a minimum first curvature radius R1, portions, which are formed with a second curvature radius R2 larger than the above-described first curvature radius R1, on a rear side of the front end 18*b* with the first curvature radius R1, and portions, which are formed with a maximum third curvature radius R3, on a further rear side than the portions with the second curvature radius R2.

The first spouting port 24 is provided at a left-side front position of the bowl 6 and a position where the third curvature radius R3 is shifted to the second curvature radius R2 in the inner circumference surface 18*a* of the rim 18.

In a region P1 which is formed with the minimum first curvature radius R1 in the inner circumference surface 18*a* of the rim 18, a protrusion 40 that protrudes laterally toward the inside of the bowl 6 (center of the bowl 6) is provided in the inner circumference surface 18*a* of the rim 18. In other words, in the inner circumference surface 18*a* of the rim 18, the protrusion 40 is formed in at least a portion where the curvature radius is minimized.

More specifically, the protrusion 40 is provided on the downstream side of the first spouting port 24 and in the vicinity of the first spouting port 24, and is provided over the entire region P1 (full length in a direction in which the flush water circulates). Hereby, when the water is spouted from the first spouting port 24, the protrusion 40 is used to cause a part of the flush water that seeks to circulate on the inner circumference surface 18*a* of the rim 18 to flow downward to the waste receiving surface 16.

Next, as illustrated in FIGS. 6, and 7A to 7E, the rim 18 has the inner circumference surface 18*a* around the entire circumference of the bowl 6, the inner circumference surface 18*a* being formed to rise upward from a lower end of the rim 18 and project from an upper end of the rim 18 to the inside of the bowl 6.

Figure 6:
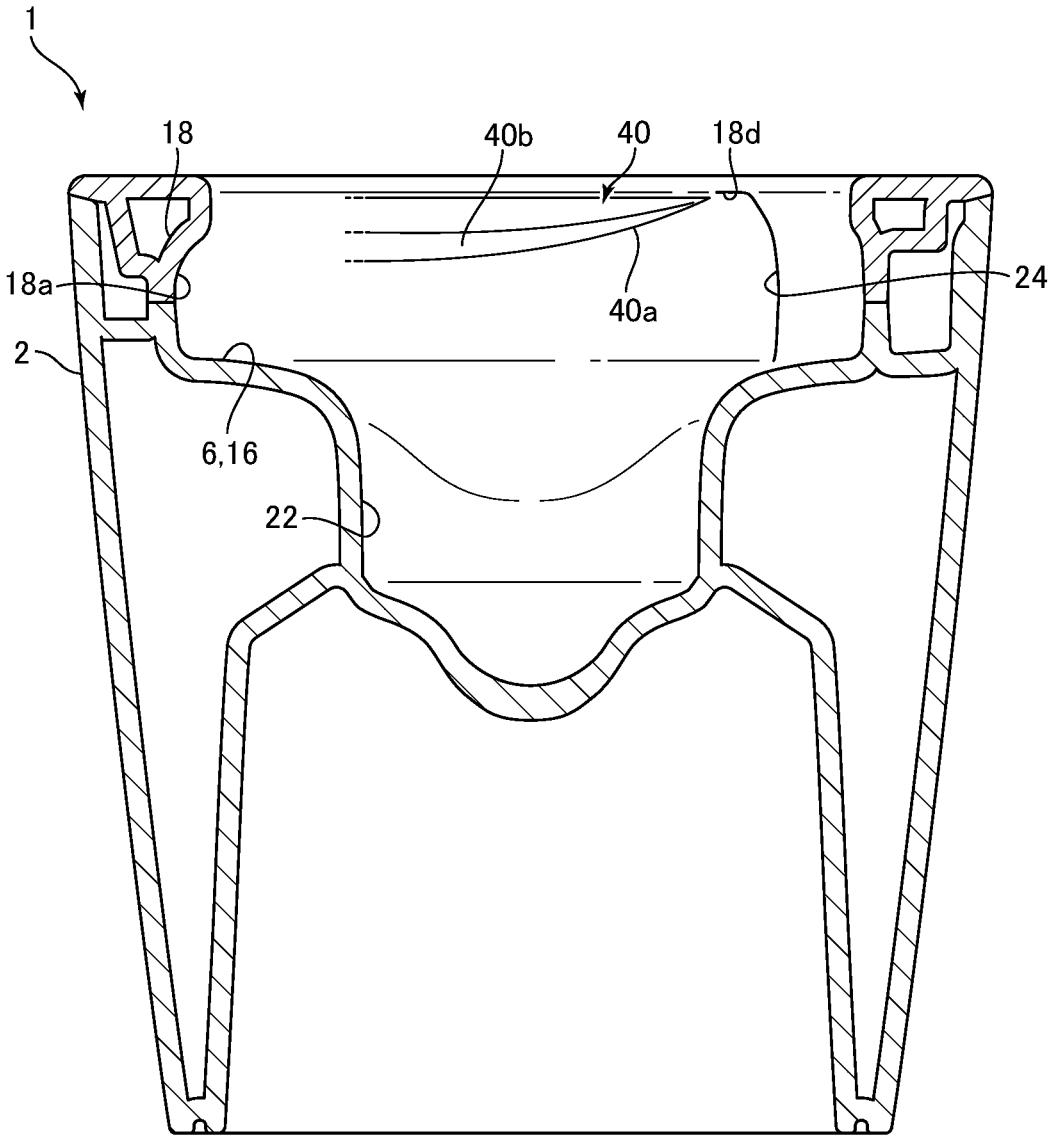
FIG. 6 is a sectional view taken along line VI-VI in FIG. 2.

As illustrated in FIG. 6, the protrusion 40 is provided in the region P1 and in a region above the center axis in the up and down direction of the inner circumference surface 18*a* of the rim 18. The protrusion 40 is provided in the region P1 and in almost the entire region above the inner circumference surface 18*a* of the rim 18.

The protrusion 40 is made of ceramics integrally with the rim 18, and is formed continuously with the inner circumference surface 18*a* of the rim 18 to form smooth curve.

As illustrated in FIG. 6, the width in the up and down direction of the protrusion 40 is formed to gradually increase in the flow direction of the flush water that circulates on the inner circumference surface 18*a* of the rim 18. That is, the width in the up and down direction of the protrusion 40 decreases closer to the first spouting port 24 and increases farther from the first spouting port 24.

The width in the up and down direction of the protrusion 40 is set to a length of about half of the length in the up and down direction of the inner circumference surface 18*a* of the rim 18, at the front end 18*b* of the rim 18.

Hereby, at the front end 18*b* of the rim 18 that is most affected by the centrifugal force, the protrusion 40 is used to cause a part of the flush water that seeks to circulate to flow downward to the waste receiving surface 16.

A lower end 40*a* of the protrusion 40 is gradually inclined downward in the flow direction of the flush water that circulates on the inner circumference surface 18*a* of the rim 18. The lower end 40*a* of the protrusion 40 is inclined downward at an inclination angle of about 30° with respect to the horizontal direction. Hereby, the flush water that circulates on the inner circumference surface 18*a* of the rim 18 is guided downward by the lower end 40*a* of the protrusion 40, and flows downward to the waste receiving surface 16.

The lower end 40*a* of the protrusion 40 is inclined from the vicinity of the first spouting port 24 to the front end 18*b* of the rim 18, and the downstream side of the lower end 40*a* is substantially more horizontal than the front end 18*b* of the rim 18. Hereby, the flush water that circulates from the first spouting port 24 to the front end 18*b* of the rim 18 that is most affected by the centrifugal force is guided further downward by the protrusion 40, and the flush water that has passed through the front end 18*b* is guided so as to circulate rearward.

Figure 7A:
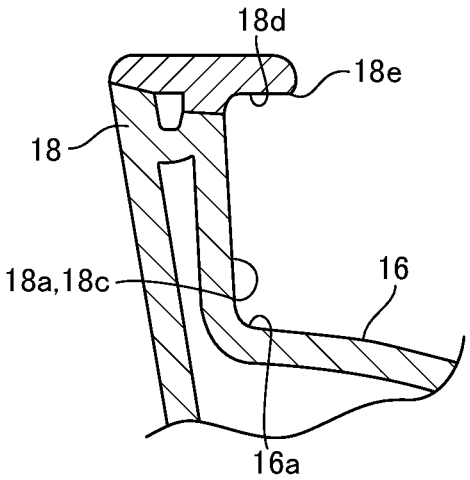
FIG. 7A is a flow path sectional view taken along line VIIA-VIIA perpendicular to a flow direction of flush water in a rim illustrated in FIG. 2.

Next, as illustrated in FIG. 7A, at a position of the VIIA cross section between the first spouting port 24 and the protrusion 40, the inner circumference surface 18*a* of the rim 18 includes a vertical surface 18*c* extending upward in the vertical direction from a lower end thereof, and a horizontal surface 18*d* extending in the horizontal direction from an upper end of the vertical surface 18*c* toward the inside of the bowl 6. The vertical surface 18*c* and the horizontal surface 18*d* are connected to intersect at an inclination angle of about 90°. A small curved surface that is recessed outward connects between the vertical surface 18*c* and the horizontal surface 18*d*. That is, at the position of the VIIA cross section between the first spouting port 24 and the protrusion 40, the protrusion 40 is not formed.

Furthermore, each of the vertical surface 18*c* and the horizontal surface 18*d* is formed by a flat surface. Hereby, the flush water spouted from the first spouting port 24 flows on the vertical surface 18*c* or the horizontal surface 18*d* to thereby be adjusted.

Figure 7B:
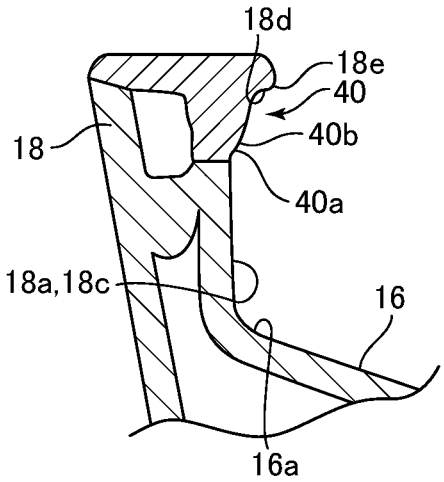
FIG. 7B is a flow path sectional view taken along line VIIB-VIIB perpendicular to the flow direction of flush water in the rim illustrated in FIG. 2.

As illustrated in FIG. 7B, at a position of the VIIB cross section in the region P1 on the upstream side of the front end 18*b* of the rim 18, the inner circumference surface 18*a* of the rim 18 includes a vertical surface 18*c* extending upward in the vertical direction from a lower end thereof, a horizontal surface 18*d* extending in the horizontal direction from an upper end of the vertical surface 18*c* toward the inside of the bowl 6, and the protrusion 40 provided between the vertical surface 18*c* and the horizontal surface 18*d* and protruding toward the inside of the bowl 6. The protrusion 40 is formed by a curved surface connecting between the vertical surface 18*c* and the horizontal surface 18*d* of the rim 18, the curved surface bulging toward the inside of the bowl 6. Furthermore, a lower surface 40*b* of the protrusion 40 is inclined upward toward the inside of the bowl 6.

Figure 7C:
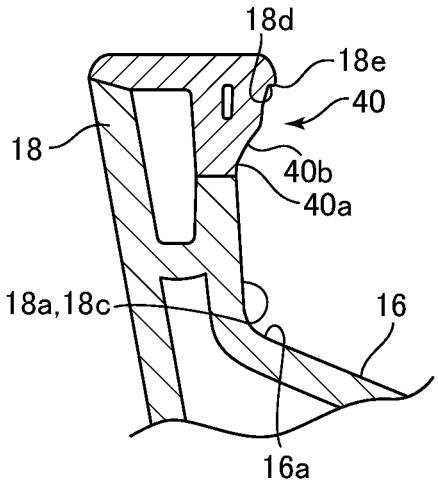
FIG. 7C is a flow path sectional view taken along line VIIC-VIIC perpendicular to the flow direction of flush water in the rim illustrated in FIG. 2.

As illustrated in FIG. 7C, at a position of the VIIC cross section in the region P1 on the upstream side of the front end 18*b* of the rim 18, the degree of the protrusion 40 protruding toward the inside of the bowl 6 is larger than that at the position of the VIIB cross section. Furthermore, the width in the up and down direction of the protrusion 40 and the width in the up and down direction of the lower surface 40*b* are larger than those at the position of the VIIB cross section.

Figure 7D:
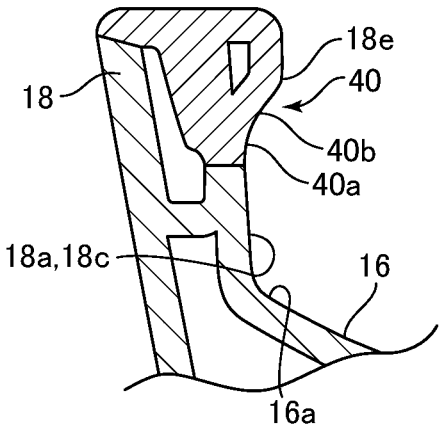
FIG. 7D is a flow path sectional view taken along line VIID-VIID perpendicular to the flow direction of flush water in the rim illustrated in FIG. 2.

As illustrated in FIG. 7D, at a position of the VIID cross section of the front end 18*b* of the rim 18, the degree of the protrusion 40 protruding toward the inside of the bowl 6 is further larger than that at the position of the VIIC cross section. Furthermore, the width in the up and down direction of the protrusion 40 and the width in the up and down direction of the lower surface 40*b* are further larger than those at the position of the VIIC cross section.

Figure 7E:
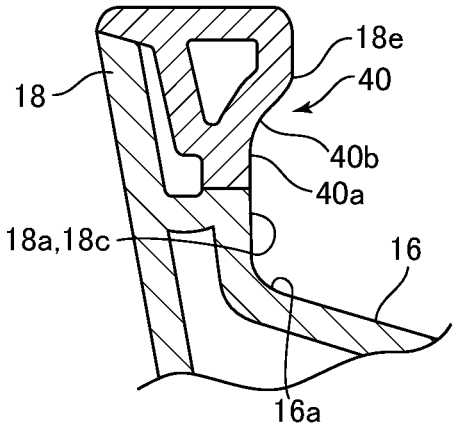
FIG. 7E is a flow path sectional view taken along line VIIE-VIIE perpendicular to the flow direction of flush water in the rim illustrated in FIG. 2.

As illustrated in FIG. 7E, at a position of the VIIE cross section in the region P1 on the downstream side of the front end 18*b* of the rim 18, the degree of the protrusion 40 protruding toward the inside of the bowl 6 is substantially the same as that at the position of the VIID cross section. Furthermore, the width in the up and down direction of the protrusion 40 and the width in the up and down direction of the lower surface 40*b* are substantially the same lengths as those at the position of the VIID cross section.

As described above, the degree of the protrusion 40 protruding toward the inside of the bowl 6 is formed to be increased toward the downstream (see FIGS. 7B to 7D). Furthermore, the width in the up and down direction of the protrusion 40 increases toward the downstream (see FIG. 6). Thus, as flush water circulates toward the downstream, the flush water flows downward more easily.

The lower surface 40*b* of the protrusion 40 is inclined upward toward the inside of the bowl 6 (see FIGS. 7B to 7E). This makes it easier to clean the lower surface 40*b* from above as compared to the case where the lower surface 40*b* of the protrusion 40 is horizontal. Furthermore, the width in the up and down direction of the lower surface 40*b* of the protrusion 40 increases toward the downstream (see FIG. 6), which makes it further easier to clean the lower surface 40*b*.

As illustrated in FIGS. 7B to 7E, an outer circumference surface 16*a* of the waste receiving surface 16 outside of a straight line drawn downward in the vertical direction from an inner circumference edge 18*e* of the rim 18 is formed to be inclined downward toward the inside of the bowl. An inclination angle of the outer circumference surface 16*a* of the waste receiving surface 16 becomes the maximum at the front end 18*b* of the rim 18 (see FIG. 7D). Hereby, at the front end 18*b* of the rim 18 that is most affected by the centrifugal force, the flush water easily flows downward.

Next, a state where flush water flows into a pooled water surface in the flush toilet 1 according to the first embodiment of the present invention will be described with reference to FIG. 8.

As illustrated in FIG. 8, for the convenience of the description, the pooled water surface 20 formed inside the well portion 22 is divided into four regions consisting of a first region S1 on a left rear side, a second region S2 on a right rear side, a third region S3 on a right front side, and a fourth region S4 on a left front side by a center axis in the left and right direction of the pooled water surface extending in the front and rear direction and a center axis in the front and rear direction of the pooled water surface extending in the left and right direction.

As illustrated in FIG. 8, first, a part of the flush water spouted from the first spouting port 24 circulates on the inner circumference surface 18*a* of the rim 18, and the majority thereof flows downward to the waste receiving surface 16 to form a forward main flow F1. After flowing in a front region of the waste receiving surface 16 of the bowl 6, the forward main flow F1 of the flush water reaches a rear region of the waste receiving surface 16, and flows into the region S2 and the region S1 of the pooled water surface 20 that are target regions. Hereby, the front region and rear region on the right side of the waste receiving surface 16 are flushed.

Next, a part of the flush water spouted from the second spouting port 26 circulates on the inner circumference surface 18*a* of the rim 18, and the majority thereof flows downward to the waste receiving surface 16 to form a rearward main flow F2. After flowing in a rear region of the waste receiving surface 16 of the bowl 6, the rearward main flow F2 reaches a front region of the waste receiving surface 16, and flows into the region S4 and the region S3 of the pooled water surface 20. Hereby, the rear region and front region on the left side of the waste receiving surface 16 are flushed.

As apparent from FIG. 8, in the flush toilet 1 according to the first embodiment of the present invention, the entire waste receiving surface 16 is flushed uniformly without joining of the forward main flow F1 and the rearward main flow F2 of the flush water, so that the flush water flows into the pooled water surface 20. This enables improvement in flushing performance of the bowl 6.

Furthermore, each of the forward main flow F1 and the rearward main flow F2 of the flush water flows into four divided regions S1, S2, S3, and S4 having different boundaries. Thus, the flush water flows into at least three regions among the four divided regions S1, S2, S3, and S4 in the pooled water surface during an initial stage of flushing, which makes it possible to advance discharge timing of floating waste, and further, when the pressing force is applied to the entire surface of the pooled water surface 20, the discharge force of the floating waste can be enhanced without generating disturbance in the pooled water surface 20.

Hereinafter, the operations and effects of the above-described first embodiment will be described.

First, in the flush toilet 1 according to the first embodiment of the present invention, since the first water passage 28 includes the lower water passage 36 formed into a vertically long rectangular shape, and the upper water passage 38 formed to have a smaller width than the width of the lower water passage 36 and extending upward from the lower water passage 36, the lower water passage 36 is filled with the flush water when the flush water is supplied to the lower water passage 36, and air retained in the first water passage 28 is forced upward to the upper water passage 38. Hereby, the flush water flows in the lower water passage 36 and the air flows in the upper water passage 38, whereby the air and the flush water can flow while separating from each other.

Since the height dimension (h1 and H1) of the first spouting port 24 is set to be substantially the same as the height dimension of the first water passage 28, the flush water is spouted from the lower region (lower opening 32) of the first spouting port 24 toward the target regions in the bowl 6, and the air is discharged from the upper region (upper opening 34) of the first spouting port 24. Thus, the air and the flush water are discharged from the first spouting port 24 while separating from each other, which makes it possible to suppress involvement of air at the first spouting port 24 and spout the flush water from the first spouting port 24 toward the target regions in the bowl 6.

In particular, for example, in the wash down flush toilet 1 having a large pooled water surface, the flush water is spouted from the first spouting port 24 toward the target regions (S1 and S2) in the pooled water surface 20 so that the pressing force can be applied to the entire surface of the pooled water surface 20, whereby the discharge force of the floating waste can be enhanced without generating disturbance in the pooled water surface 20.

In the flush toilet 1 according to the first embodiment of the present invention, since on the downstream side of the first water passage 28, the upper surface 36*a* of the lower water passage 36 is inclined downward from the upstream toward the first spouting port 24, a downward flow is formed by the lower water passage 36, which makes it possible to spout the water downward from the lower opening 32 of the first spouting port 24, whereby the forward main flow F1 can be formed.

In the flush toilet 1 according to the first embodiment of the present invention, since on the downstream side of the first water passage 28, the upper surface 36*a* of the lower water passage 36 is gradually inclined downward from the upstream toward the first spouting port 24, the downward flow can be formed by the lower water passage 36 while adjusting the flush water.

In the flush toilet 1 according to the first embodiment of the present invention, since on the downstream side of the first water passage 28, the upper surface 38*a* of the upper water passage 38 extends in the horizontal direction from the upstream toward the first spouting port 24, a large space in which air can be accommodated can be formed in the upper water passage 38, so that the air and the flush water can be discharged from the first spouting port 24 while reliably separating from each other.

In the flush toilet 1 according to the first embodiment of the present invention, since the first spouting port 24 is disposed on the front side of the center axis in the front and rear direction of the bowl 6, the distance of the first water passage 28 can be increased, and the air and the flush water can be discharged from the first spouting port 24 while reliably separating from each other.

In the flush toilet 1 according to the first embodiment of the present invention, since the first spouting port 24 includes the lower opening 32 formed into a vertically long rectangular shape, and the upper opening 34 formed to have a smaller width than the width of the lower opening 32 and extending upward from the lower opening 32, the flush water is spouted from the lower opening 32 of the first spouting port 24 toward the target regions in the bowl 6, and the air is discharged from the upper opening 34 of the first spouting port 24. Thus, the air and the flush water are discharged from the first spouting port 24 while separating from each other, which makes it possible to suppress involvement of air at the first spouting port 24 and spout the flush water from the first spouting port 24 toward the target regions in the bowl 6.

In the flush toilet 1 according to the embodiment of the present invention, since the first spouting port 24 is formed to be vertically long, and the protrusion 40 that protrudes toward the inside of the bowl 6 is provided on the inner circumference surface 18*a* of the rim 18 on the downstream side of the first spouting port 24, the protrusion 40 is used to cause a part of the flush water that circulates on the inner circumference surface 18*a* of the rim 18 to flow downward to enable flushing of the waste receiving surface 16. This enables improvement in flushing performance of the bowl 6. Furthermore, this can suppress splashing of the flush water out of the flush toilet.

In the flush toilet 1 according to the embodiment of the present invention, since the first spouting port 24 is provided on the front side of the center axis in the front and rear direction of the bowl 6 and the protrusion 40 is provided at the front end 18*b* of the inner circumference surface 18*a* of the rim 18, even when the flush water flows at the front end 18*b*, which is most affected by the centrifugal force, immediately after the flush water is spouted, the protrusion 40 is used to cause the flush water to flow downward to enable flushing of the waste receiving surface 16.

In the flush toilet 1 according to the embodiment of the present invention, since the protrusion 40 is provided at least on the front side of the center axis in the front and rear direction of the bowl 6 and at a portion that is formed with the minimum curvature radius R1 in the inner circumference surface 18*a* of the rim 18 in a plan view of the bowl 6, when the flush water flows at a portion formed with the minimum curvature radius R1, the protrusion 40 is used to cause the flush water to flow downward to enable flushing of the waste receiving surface 16. At the portion formed with the minimum curvature radius R1 where the flush water is highly likely to splash out of the flush toilet, the protrusion 40 is used to cause the flush water to flow downward, which makes it possible to suppress splashing of the flush water out of the flush toilet.

In the flush toilet 1 according to the embodiment of the present invention, since the lower end 40*a* of the protrusion 40 is inclined downward toward the flow direction of the flush water that circulates on the inner circumference surface 18*a* of the rim 18, the protrusion 40 is used to cause a part of the circulating flush water to flow downward to enable flushing of the waste receiving surface 16.

In the flush toilet 1 according to the embodiment of the present invention, since the protrusion 40 is formed so that the degree of protrusion toward the inside of the bowl 6 increases toward the downstream, as the flush water circulates toward the downstream, the flush water flows downward to enable flushing of the waste receiving surface 16.

In the flush toilet 1 according to the embodiment of the present invention, since the lower surface 40*b* of the protrusion 40 is inclined upward toward the inside of the bowl, the lower surface 40*b* of the protrusion 40 is easily cleaned from above.

In the flush toilet 1 according to the embodiment of the present invention, since the horizontal surface 18*d* is provided above the inner circumference surface 18*a* of the rim 18 between the first spouting port 24 and the protrusion 40, the flush water can be adjusted by the horizontal surface 18*d* immediately after water spouting, and the adjusted flush water can flow to the protrusion 40.

Next, a flush toilet 100 according to a second embodiment of the present invention will be described with reference to FIGS. 9 to 11D. The basic configuration is the same as that of the flush toilet 1 according to the above-described first embodiment of the present invention except for the shapes of the downstream side of the first spouting port and the first water passage. Hereinafter, only the difference from the flush toilet 1 according to the first embodiment will be described, and the description on the similar configurations, operations, and effects will be omitted.

Figure 9:
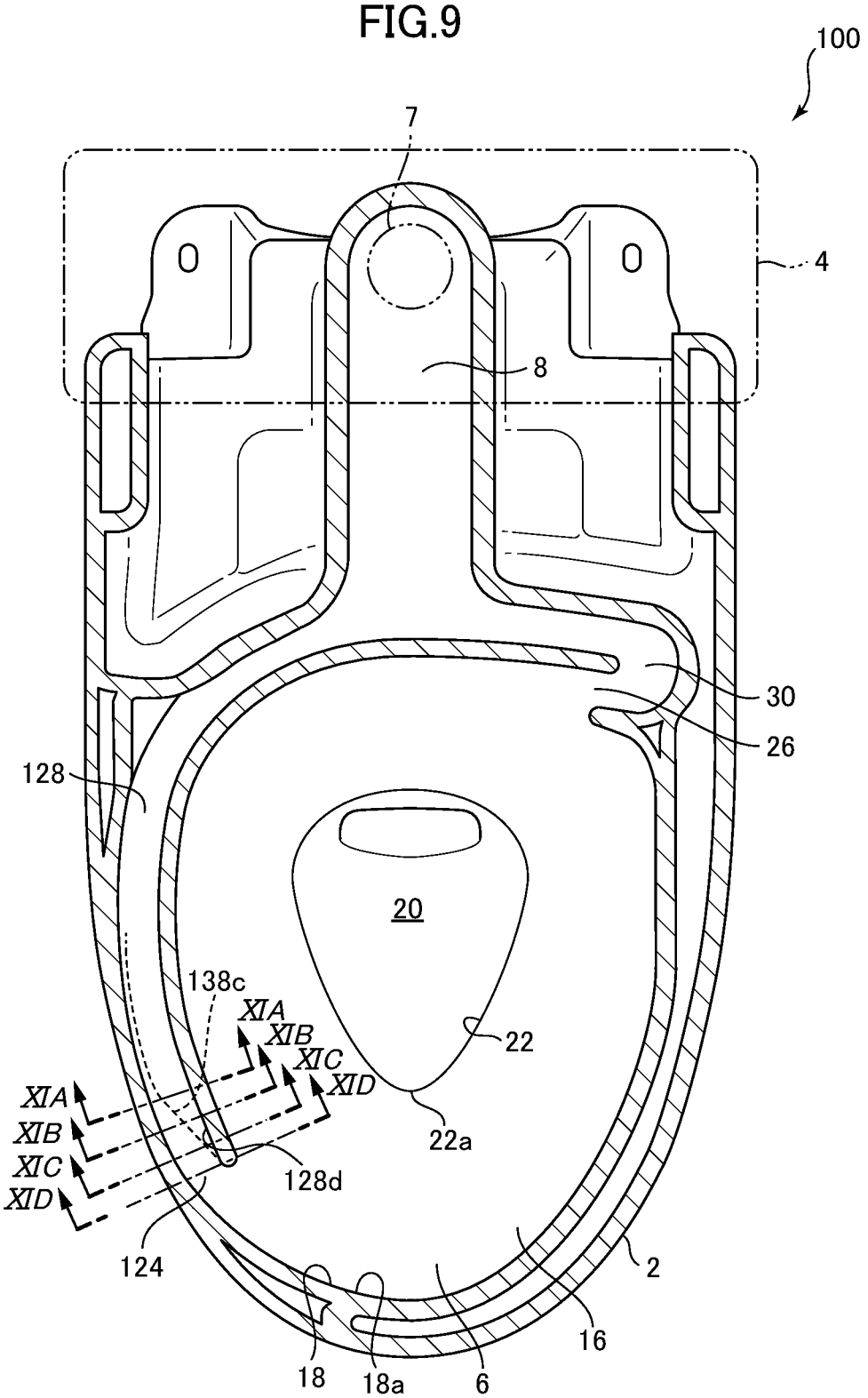
FIG. 9 is a sectional plan view of a flush toilet according to a second embodiment of the present invention.

In the flush toilet 100 according to the second embodiment of the present invention illustrated in FIGS. 9 to 11D, the same portions to those in the flush toilet 1 according to the above-described first embodiment of the present invention are denoted by the same reference numerals. FIG. 9 corresponds to FIG. 2 of the first embodiments, and a dotted line in FIG. 9 indicates a right end (inner end) 138*c* of an upper surface 138*a* in an upper water passage 138 of a first water passage 128.

Figure 10:
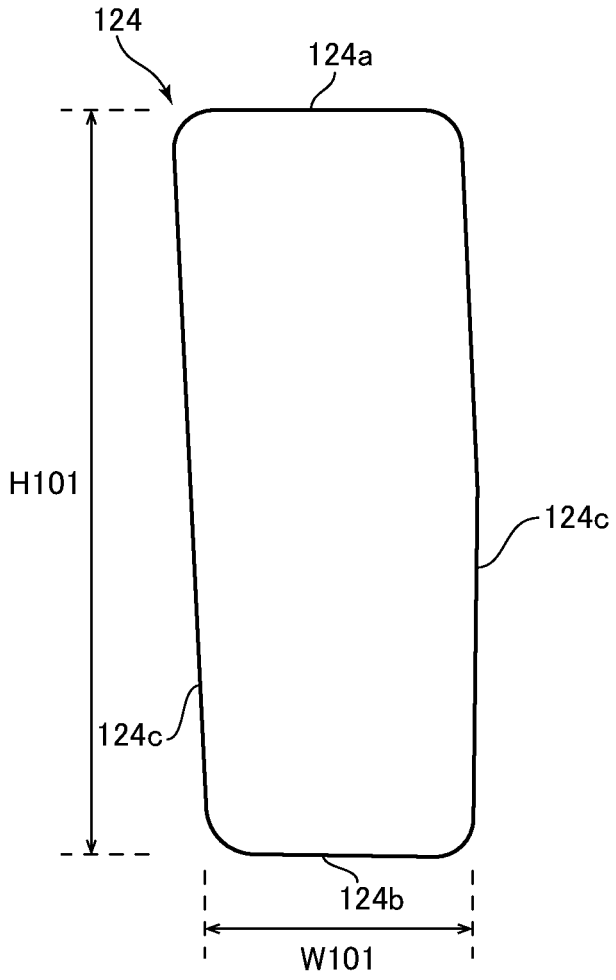
FIG. 10 is a front view of a first spouting port of the flush toilet according to the second embodiment of the present invention.

As illustrated in FIG. 10, a first spouting port 124 has an opening cross section formed into a vertically long rectangular shape (rectangular shape). Specifically, the first spouting port 124 is set so that a height dimension (H101) of its opening has substantially the same length as a height dimension (H105) of the first water passage. The first spouting port 124 is set so that a width (W101) of its opening has substantially the same length as a width (W105) of the first water passage. An upper end 124*a* and a lower end 124*b* of the first spouting port 124 are substantially horizontal, and are set to have substantially the same length. Left and right side ends 124*c* of the first spouting port 124 are substantially vertical, and are set to have substantially the same length. The height dimension (H101) of the first spouting port 124 is set to a length that is about three times the width (W101) of the first spouting port 124.

An opening sectional area of the first spouting port 124 is set to be larger than each flow path sectional area of the first water passage 128. This causes the majority of flush water to be spouted from a lower region of the first spouting port 124, thereby forming a forward main flow F1 that circulates on a bowl 6. Air is discharged from an upper region of the first spouting port 124, and the air in the first water passage 128 is discharged.

Figure 11A:
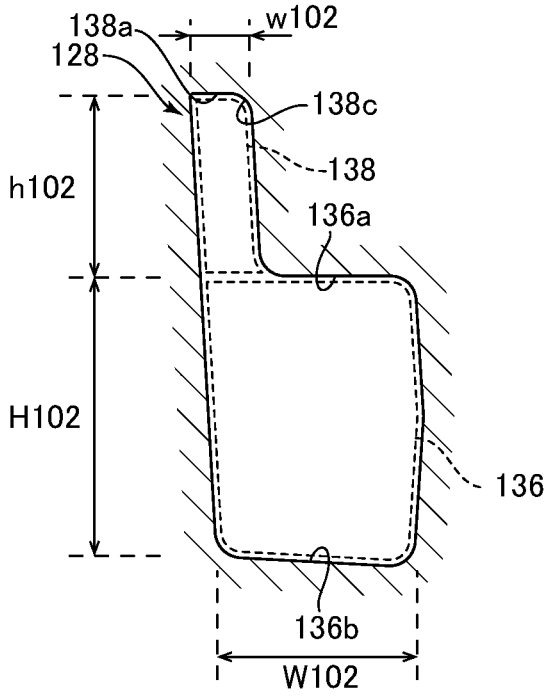
FIG. 11A is a flow path sectional view taken along line XIA-XIA perpendicular to a flow direction of flush water in a first water passage illustrated in FIG. 9.

As illustrated in FIG. 11A, in the XIA cross section, the first water passage 128 has a flow path cross section formed into an L shape in the same manner as in the above-described first embodiment. The first water passage 128 includes a lower water passage 136 (a portion enclosed by a dotted line in FIG. 11A) formed into a vertically long rectangular shape, and an upper water passage 138 (a portion enclosed by dotted line in each of FIG. 11A) formed to have a smaller width than the width of the lower water passage 136 and formed into a vertically-long rectangular shape extending upward from the lower water passage 136. An upper surface 138*a* of the upper water passage 138 and an upper surface 136*a* and a lower surface 136*b* of the lower water passage 136 are substantially horizontal. Side surfaces of the upper water passage 138 and the lower water passage 136 are substantially vertical.

Figure 11B:
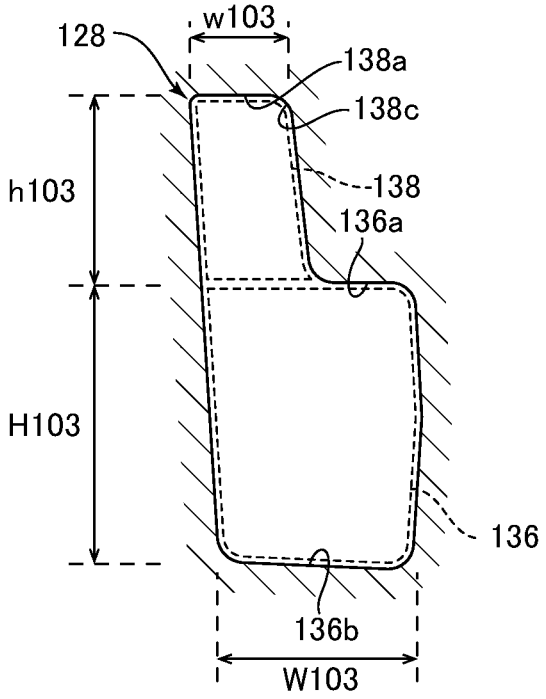
FIG. 11B is a flow path sectional view taken along line XIB-XIB perpendicular to the flow direction of flush water in the first water passage illustrated in FIG. 9.
Figure 11C:
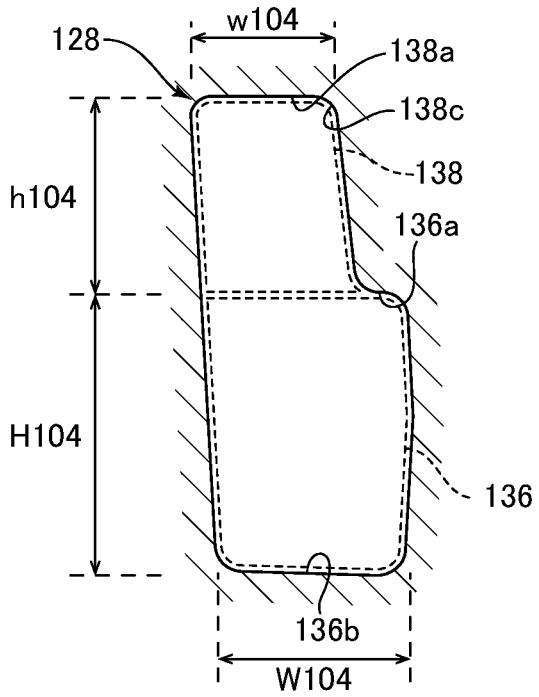
FIG. 11C is a flow path sectional view taken along line XIC-XIC perpendicular to the flow direction of flush water in the first water passage illustrated in FIG. 9.
Figure 11D:
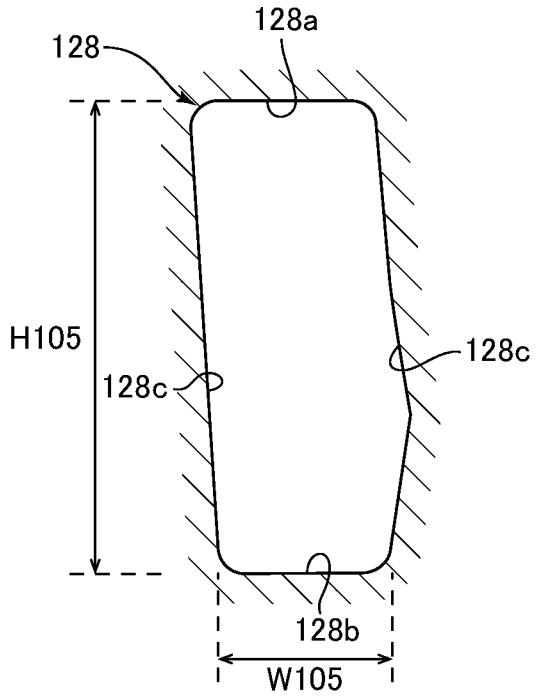
FIG. 11D is a flow path sectional view taken along line XID-XID perpendicular to the flow direction of flush water in the first water passage illustrated in FIG. 9.

On the downstream side of the XIA cross section, as illustrated in FIGS. 11B to 11D, the width (w103 to w104) of the upper water passage 138 gradually increases from the upstream toward the first spouting port 124. The height dimension (h103, h104) of the upper water passage 138 is formed to be substantially constant from the upstream toward the first spouting port 124. Each of the width (W103 to W105) of the lower water passage 136 and the height dimension (H103, H104) of the lower water passage 136 is formed to be substantially constant from the upstream toward the first spouting port 124. Thus, in the first water passage 128 on the downstream side of the XIA cross section, a flow path sectional area of the first water passage 128 gradually increases from a position of the XIA cross section toward the first spouting port 124.

As illustrated in FIG. 11D, in the XID cross section, the first water passage 128 has a flow path cross section formed into a vertically long rectangular shape (rectangular shape). Specifically, an upper surface 128*a* and a lower surface 128*b* of the first water passage 128 are substantially horizontal, and are set to have substantially the same length. Left and right side surfaces 128*c* of the first water passage 128 are substantially vertical, and are set to have substantially the same length. The first water passage 128 on the downstream side of the XID cross section has a flow path cross section that is substantially constant in shape and area, and is continuously connected to the first spouting port 124.

As illustrated in FIG. 9, the width (or the flow path sectional area) of the upper water passage 138 starts to increase from a predetermined position (a position of the XIA cross section) the same as or in the vicinity of a front end 22*a* of a well portion toward the first spouting port 124 in the front and rear direction (see the dotted line 138*c* in FIG. 9). In other words, the predetermined position where the width of the upper water passage 138 starts to increase is set at a position the same as or in the vicinity of the front end 22*a* of the well portion. Specifically, the predetermined position where the width of the upper water passage 138 starts to increase is set at a position of about 35 mm on the upstream side of the first spouting port 124. Thus, the predetermined position where the width of the upper water passage 138 starts to increase is set at a position of about 35 mm on the upstream side of the first spouting port 124, and therefore, after flushing starts, the first water passage 128 can be full earlier as compared to the case where the predetermined position is set in the vicinity of the first spouting port 124, to enable the air and the flush water to separate from each other.

As illustrated in FIG. 9, a water passage straight portion 128*d* extending in a substantially straight line is formed at a downstream end of the first water passage 128, and the width (or the flow path sectional area) of the upper water passage 138 increases toward the first spouting port 124 in the water passage straight portion 128*d*. A right end (inner end) 138*c* of the upper surface 138*a* of the upper water passage 138 is inclined in the inward direction of the bowl 6 toward the front in a plan view (see the dotted line 138*c* in FIG. 9). Thus, a portion where the width (or the flow path sectional area) of the upper water passage 138 increases is provided in the water passage straight portion 128*d*, which makes it possible to prevent the flush water from undergoing pressure loss due to the curvature of the water passage.

The water passage straight portion in the present invention is not limited to one extending in a perfect straight line, and includes ones slightly curved to the extent that the normal toilet flushing is not affected.

Hereinafter, the operations and effects of the above-described second embodiment will be described.

First, in the flush toilet 100 according to the second embodiment of the present invention, since the first water passage 128 includes the lower water passage 136 formed into a vertically long rectangular shape, and the upper water passage 138 formed to have a smaller width than the width of the lower water passage 136 and extending upward from the lower water passage 136, the lower water passage 136 is filled with the flush water when the flush water is supplied to the lower water passage 136, and air retained in the first water passage 128 is forced upward to the upper water passage 138. Hereby, the flush water flows in the lower water passage 136 and the air flows in the upper water passage 138, whereby the air and the flush water can flow while separating from each other.

Since the height dimension (H101) of the first spouting port 124 is set to be substantially the same as the height dimension of the first water passage 128, and is formed into a vertically long rectangular shape, the flush water is spouted from the lower region of the first spouting port 124 toward the target regions in the bowl 6, and the air is discharged from the upper region of the first spouting port 124. Thus, the air and the flush water are discharged from the first spouting port 124 while separating from each other, which makes it possible to suppress involvement of air at the first spouting port 124 and spout the flush water from the first spouting port 124 toward the target regions in the bowl 6.

In particular, for example, in the wash down flush toilet 100 having a large pooled water surface, the flush water is spouted from the first spouting port 124 toward the target regions (S1 and S2) in the pooled water surface 20 so that the pressing force can be applied to the entire surface of the pooled water surface 20, whereby the discharge force of the floating waste can be enhanced without generating disturbance in the pooled water surface 20.

In the flush toilet 100 according to the second embodiment of the present invention, since the width of the upper water passage 138 starts to increase from a predetermined position (a position of the XIA cross section) on the upstream side of the first spouting port 124 toward the first spouting port 124, and is set to be substantially the same as the width (W105) of the lower water passage 136 in a position (a position of the XID cross section) in the vicinity of the first spouting port 124, the water passage can be full early after flushing starts, to enable the air and the flush water to separate from each other. Since the width of the upper water passage 138 is set to be substantially the same as the width (W105) of the lower water passage 136 in a position (a position of the XID cross section) in the vicinity of the first spouting port 124, the cleaning performance of the upper surface 138*a* of the upper water passage 138 can be improved as compared to the above-described first embodiment.

In the flush toilet 100 according to the second embodiment of the present invention, since the first spouting port 124 is disposed on the front side of the front end 22*a* of the well portion 22, and the predetermined position (the position of the XIA cross section) where the width of the upper water passage 138 starts to increase is set to be substantially the same position as the front end 22*a* of the well portion 22 in the front and rear direction, the flush water can be spouted from the first spouting port 124 so as to circulate on the waste receiving surface 16 on the front side of the front end 22*a* of the well portion 22 (see the forward main flow F1 in FIG. 8), which makes it possible to guide the flush water to the target regions of the bowl 6.

In the flush toilet 100 according to the second embodiment of the present invention, since a portion (positions of the XIA cross section to XID cross section) where the width of the upper water passage 138 increases is provided in the water passage straight portion 128*d* in which the water passage extends in a substantially straight line, the flush water can be prevented from undergoing pressure loss due to the curvature of the water passage.

The present invention is not limited to the above-described embodiments, and various changes and modifications are possible within the scope of the technical idea described in the claims.

REFERENCE SIGNS LIST

1 Flush toilet according to first embodiment of the present invention
6 Bowl
8 Common water passage
10 Discharge conduit
16 Waste receiving surface
16*a* Outer circumference surface of waste receiving surface
18 Rim
18*a* Inner circumference surface of rim
18*b* Front end of rim
18*c* Vertical surface of rim
18*d* Horizontal surface of rim
18*e* Inner circumference edge of rim
22 Well portion
22*a* Front end of well portion
24 First spouting port
28 First water passage
32 Lower opening of first spouting port
32*a* Upper end of lower opening
32*b* Lower end of lower opening
34 Upper opening of first spouting port
34*a* Upper end of upper opening
36 Lower water passage of first water passage
36*a* Upper surface of lower water passage
36*b* Lower surface of lower water passage
38 Upper water passage of first water passage
38*a* Upper surface of upper water passage
40 Protrusion
40*a* Lower end of protrusion
40*b* Lower surface of protrusion
R1 First curvature radius
R2 Second curvature radius
R3 Third curvature radius
P1 Region formed at first curvature radius
F1 Forward main flow spouted from first spouting port
F2 Rearward main flow spouted from second spouting port
100 Flush toilet according to second embodiment of the present invention
124 First spouting port
128 First water passage
128*d* Water passage straight portion of first water passage
136 Lower water passage of first water passage
138 Upper water passage of first water passage

What is claimed is:

1. A flush toilet flushed with flush water to discharge waste, the flush toilet comprising:

a bowl that comprises a waste receiving surface that receives waste, a rim formed in an upper portion of the waste receiving surface, and a well portion formed in a lower portion of the waste receiving surface and inside which a pooled water surface is formed;

a spouting port formed in the rim, the flush water being spouted along an inner circumference surface of the rim from the spouting port;

a water passage that guides the flush water to the spouting port; and a discharge conduit connected to a bottom of the bowl, wherein the water passage includes a lower water passage formed into a vertically long rectangular shape, and an upper water passage having a smaller width than the width of the lower water passage and extending upward from the lower water passage, and a height dimension of the spouting port is set to be substantially the same as the height dimension of the water passage.

2. The flush toilet according to claim 1, wherein on a downstream side of the water passage, an upper surface of the lower water passage is inclined downward from upstream toward the spouting port.

3. The flush toilet according to claim 2, wherein on the downstream side of the water passage, the upper surface of the lower water passage is gradually inclined downward from the upstream toward the spouting port.

4. The flush toilet according to claim 2, wherein on the downstream side of the water passage, an upper surface of an upper water passage extends in a horizontal direction from the upstream toward the spouting port.

5. The flush toilet according to claim 1, wherein the spouting port is disposed on a front side of a center axis in a front and rear direction of the bowl.

6. The flush toilet according to claim 1, wherein the spouting port includes a lower opening formed into a vertically long rectangular shape, and an upper opening formed to have a smaller width than the width of the lower opening and extending upward from the lower opening.

7. The flush toilet according to claim 1, wherein a width of the upper water passage starts to increase from a predetermined position on an upstream side of the spouting port toward the spouting port, and is set to be substantially the same as the width of the lower water passage in a position in a vicinity of the spouting port.

8. The flush toilet according to claim 7, wherein the spouting port is disposed on a front side of a front end of the well portion, and the predetermined position where the width of the upper water passage starts to increase is set to be substantially the same position as the front end of the well portion in a front and rear direction.

9. The flush toilet according to claim 7, wherein a portion where the width of the upper water passage increases is provided in a water passage straight portion in which a water passage extends in a substantially straight line.

10. The flush toilet according to claim 1, wherein the spouting port is formed to be vertically long, and a protrusion that protrudes toward an inside of the bowl is provided on the inner circumference surface of the rim on a downstream side of the spouting port.

11. The flush toilet according to claim 10, wherein the spouting port is disposed on a front side of a center axis in a front and rear direction of the bowl, and the protrusion is provided at a front end of the inner circumference surface of the rim.

12. The flush toilet according to claim 10, wherein the protrusion is provided at least on a front side of a center axis in a front and rear direction of the bowl and at a portion formed with a minimum curvature radius in the inner circumference surface of the rim in a plan view of the bowl.

13. The flush toilet according to claim 10, wherein the protrusion is formed so that a degree of protrusion toward the inside of the bowl increases toward downstream, a lower end of the protrusion is inclined downward in a flow direction in which the flush water circulates on the inner circumference surface of the rim, and a lower surface of the protrusion is inclined upward toward the inside of the bowl.

* * * * *